United States Patent [19]

Koppelomäki

[11] Patent Number: 4,611,552

[45] Date of Patent: Sep. 16, 1986

[54] BOARDING STEPS

[76] Inventor: Leo Koppelomäki, Almgatan 23, S-333 00 Smålandsstenar, Sweden

[21] Appl. No.: 663,746

[22] Filed: Oct. 23, 1984

[30] Foreign Application Priority Data

Nov. 23, 1983 [SE] Sweden ..... 8306458

[51] Int. Cl.[4] ..... B63B 35/00

[52] U.S. Cl. ..... 114/343; 114/362; 182/92

[58] Field of Search ..... 114/362; 182/92, 97, 182/115, 83, 82; D25/62, 63, 64

[56] References Cited

U.S. PATENT DOCUMENTS

| | | | |
|---|---|---|---|
| 2,309,210 | 1/1943 | Phillips | 182/83 |
| 3,828,707 | 8/1974 | Young | 182/92 X |
| 4,146,941 | 4/1979 | Haslam | 114/362 |
| 4,495,883 | 1/1985 | Hoy | 114/362 |

*Primary Examiner*—Trygve M. Blix
*Assistant Examiner*—Edwin L. Swinehart
*Attorney, Agent, or Firm*—Beveridge, DeGrandi & Weilacher

[57] ABSTRACT

A boarding step is disclosed for mounting on a towing ring (9) fixedly disposed on the stem (19) of a pleasure craft, for facilitating the stepping into and out of the craft. The boarding step comprises two carrier arms (1) which at their portions (4) which are urged against the craft and have rubber coatings, and which, at their outer ends, are provided with a horizontal tread platform (2). The tread platform has, on its underface, an adjustment rail (5) with a number of alternative pivotal anchorage points (14) for a support strut (6) which, at its end facing the craft, is provided with a pivotal, U-shaped abutment portion (7) urged against the stem (19) of the craft. The support strut has a number of alternative anchorage points (11) for a bolt (10) which also engages with the ring (9) fixed in the stem and which, on tightening, urges the boarding step to a positionally-fixing frictional engagement with the craft. An adjustable stay (15) extends between the carrier arms and the support strut.

7 Claims, 3 Drawing Figures

BOARDING STEPS

TECHNICAL FIELD

The present invention relates to a type of step which is designed to be readily mounted on a boat, preferably at the stem, and there serve as an aid in stepping into and out of the boat, in particular when the boat is in very shallow water.

BACKGROUND ART

On larger pleasure craft, use is generally made of ladders which, as a rule, are premanently screwed in place at the stern of the vessel and may most often be pivoted downwardly so that a part of the ladder is immersed in the water. Ladders of this type are often mounted on the vessel by making holes through the hull and thereafter screwing the ladder in place. This entails that a certain amount of damage is done to the hull in such a manner that replacement or removal of the ladder would involve troublesome repairs, often repainting of the entire vessel.

In such situations when a large pleasure craft is run or sailed into shallow water so as to enable the occupants to make land by wading ashore, the boat is, as a rule, run or sailed stem-first in, since the stem often has the least draught. The reason for this is that there are often propellers, keel, rudder and similar details beneath the stern of the vessel, details which are either relatively fragile or extend quite some distance beneath the bottom of the vessel. Since the ladders which are in general use today are, as a rule, placed at the stern of the vessel, this would entail that the water is quite deep and, as a result, does not offer an attractive prospect for making land by this means.

A vessel which has been run or sailed in towards a beach in the above-described manner often enjoys relatively shallow water at the stem, for which reason a ready means of making land is available from the stem of the craft. However, serious problems from a purely practical point of view arise here, since the stem is so high that a person standing on the sea bottom can hardly get into the craft without assistance, even though the water may, at this point, be as little as knee-deep.

To facilitate entering and leaving the vessel, use has earlier been made in the art of different types of loose aids, such as steps, ladders and the like which, on occasions, have been placed on the sea bottom and, on occasions, have been suspended freely from the stem of the boat, and, on other occasions, have been leant against the side of the boat as a conventional ladder. All of these loose aids involve practical drawbacks, not least because there is normally little space on board for storing loose articles and details.

It might, in itself, be conceivable to permanently screw in place, at or adjacent the stem of the boat, different types of ladders or the like, but, as has been mentioned above, such an operation often entails far-reaching interference with the hull so that replacement or dismantling of the ladder would cause serious damage and possibly the necessity of repainting the entire vessel.

Prior art shipping ladders and other aids for stepping into or out of boats have also suffered from serious drawbacks in that they must be specially designed for each individual craft. As a result, one and the same ladder can hardly be used for different vessel types or boat models, since the slope, height etc. of the hull may vary widely.

OBJECT OF THE PRESENT INVENTION

Hence, the object of the present invention is to realise a step which may be mounted on a pleasure craft as good as irrespective of its design, preferably at the stem of the vessel, without the need of interfering to any great extent with the hull of the vessel.

SOLUTION

According to the present invention, this object is achieved if the step is characterised by a projecting carrier arm with a tread platform, a support strut which, with its one end, is connected to the carrier arm, the mutual relative position, in a direction towards or away from the boat, of the ends of the carrier arm and support strut turned to face the boat being adjustable by adjustment devices for adapting the tread platform to the configuration of the boat, these ends being urged against the boat by means of a tensioning device fixedly anchored in the boat.

The subject matter of the present invention is further also suitably characterised in that the relative positions of the carrier arm and the support strut may be fixedly locked by means of a support member.

To eliminate damage to the hull and to improve the retentive properties of the tread platform, the platform is suitably also characterised in that the ends of the carrier arm and the support strut urged against the boat are provided with friction-increasing means for cooperation with the surface of the boat.

In order further to increase the flexiblity of the subject matter of the present invention, it also suitably applies that the support strut and/or the carrier arm are provided, at their ends facing the boat, with engagement portions which may be aligned depending on the orientation of that surface of the vessel structure against which they are urged.

Further advantages will be attained if the subject matter of the present invention is also given any one or more of the features as set forth in claims 5 to 8.

BRIEF DESCRIPTION OF THE ACCOMPANYING DRAWINGS

The invention will now be described in greater detail below, with reference to the accompanying Drawings, in which.

DESCRIPTION OF PREFERRED EMBODIMENT

Figure 1:
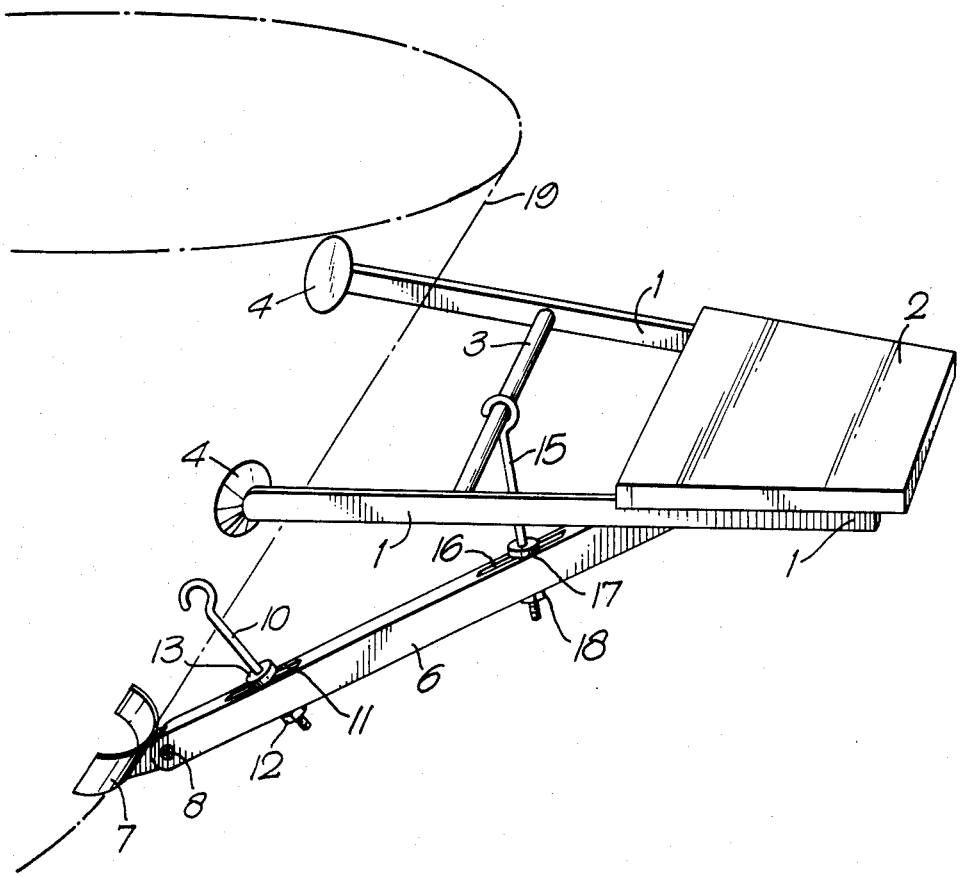
FIG. 1 is a schematic perspective view of the subject matter of the present invention, in the position it assumes as mounted on the stem of a boat.
Figure 2:
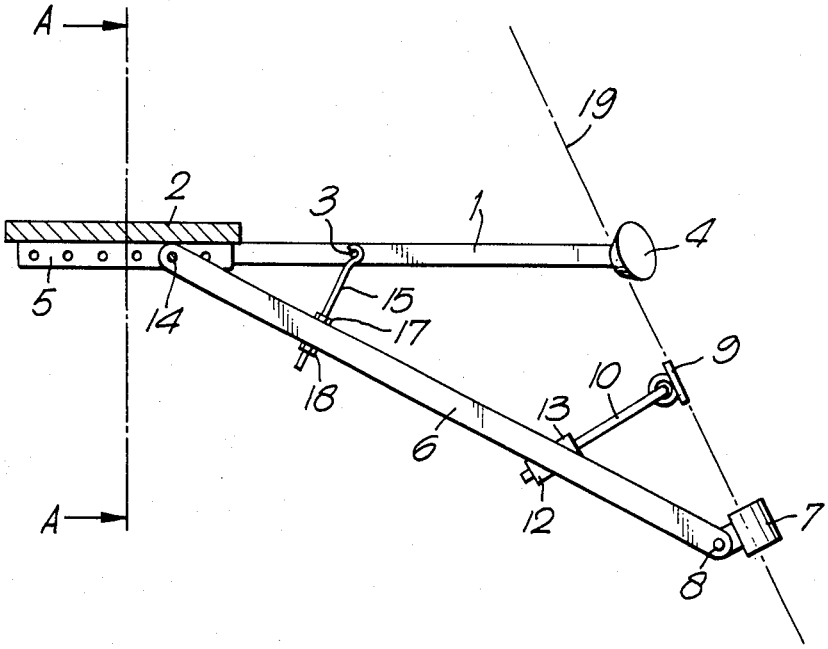
FIG. 2 is a schematic straight side elevation of the subject matter of the present invention, certain details having been cut away for purposes of clarity.
Figure 3:
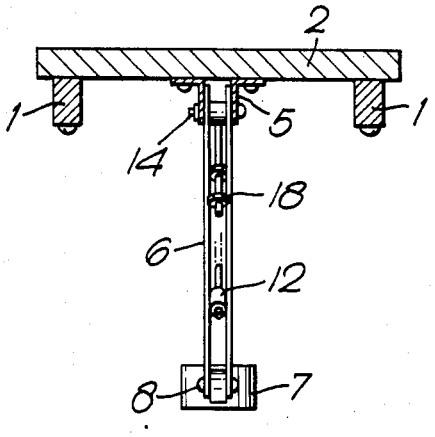
FIG. 3 is a cross section taken approximately along the line A—A in FIG. 2.

It will be apparent from the accompanying Drawings that the subject matter of the present invention comprises two upper and, in the position of use of the invention, approximately horizontal carrier arms 1. These have, at their outer ends, a tread platform 2 in the form of a panel which has, on its upper face, a non-slip surface structure. The tread platform 2 may serve to interconnect the two free ends of the carrier arms, but, alternatively, these may also be interconnected by means of a cross piece disposed beneath the tread platform. Furthermore, the carrier arms are connected by the intermediary of a transverse stay 3 so that, thereby, the carrier arms, the tread platform and the cross piece will form a rigid unit.

The inner ends of the carrier arms 1, i.e. the ends facing the hull, are provided with abutment portions 4 which have friction-increasing coatings on their surfaces facing the hull. The abutment portions are designed to be urged against the hull and thereby positionally fix the carrier arms in relation thereto.

In order to permit the employment of the subject matter of the present invention on several types of boats, it is essential that the abutment portions either be of such configuration that they are not dependent upon the design of the hull, or that they are movably connected to the inner end portions of the carrier arms so that they may adapt to meet the orientation of the surface portions of the hull with which they are to cooperate. It is also vital that the tread platform can be adjusted at approximately horizontal position irrespective of the design of the boat. According to the invention, the abutment portions 4 may suitably be connected to the inner ends of the carrier arms by the intermediary of ball-and-socket joints, resiliently yieldable plastic or rubber connections, hinges or the like.

In the embodiment illustrated on the Drawings, the tread platform 2 has, on its underface, two adjustment rails 5 which serve for pivotal and shiftable retention of a support strut 6. This is provided, at its lower end facing the hull, with an abutment portion 7 which may suitably be fixedly retained in the support strut 6 by means of a joint 8 and may also be of arched configuration so as to embrace the stem 19 of the boat. The abutment portion 7 is also provided with a friction-increasing and protective material layer on its side turned to face the boat, and is operative to be urged fast against the stem.

As was mentioned by way of introduction, the object of the present invention is that it be applicable to a boat without the risk of causing any appreciable damage to its hull. This is attained according to the invention in that the subject matter of the invention is held in place partly by frictional engagement between the abutment portions 4 and 7 and the hull, and partly in that these abutment portions engage with the hull in a three-point suspension, and partly in that the subject matter of the present invention is lockingly tightened towards the hull at one single anchorage point.

The stem of many pleasure craft is provided with a towing ring 9 which is used for towing the boat, mooring it, but perhaps above all when the boat is to be winched up onto a trailer. As a rule, this ring is fitted as standard, but may easily be mounted on the stem without the need of causing any damage to the rest of the boat.

According to the invention, the above-mentioned ring is used as an anchorage point for the subject matter of the present invention in that there is disposed, between the support strut 6 and the ring 9, a tensioning device 10 which, in its simplest embodiment, may be designed as a bolt which is threaded at one end and provided with a hook at the other, the hook extending through an opening 11 in the support strut 6. For tightening the bolt, and thereby also for drawing the subject matter of the present invention fast against the hull, the nut 12 located on the outside of the support strut 6 is tightened, whereafter the tensioning device is locked with a lock nut 13.

Since the tensioning device, as has been described above, is tightened towards the hull of the boat, the three abutment portions 4 and 7 will be urged against the boat whereby they, partly thanks to their friction-increasing coatings, will reliably be positionally-fixed in relation to the boat. As a result, the upper abutment portions 4 will be prevented from sliding upwardly since, as a rule, the hull broadens in an upward direction.

In order to obviate the risk that the carrier arms 1 are turned in a clockwise direction should anyone happen to step on the tread platform 2 short of the movable and pivotal anchorage 14 between the support strut 6 and the tread platform 2, a support member 15 is disposed between the support strut 6 and the cross piece 3. This support member may, in its simplest form, consist of a threaded bolt connected to the cross piece 3 and extending through a preferably slot-shaped opening 16 in the support strut 6 and being provided with a nut 17 and 18, respectively, on either side of the support strut 6.

Apart from preventing the tread platform 2 from tipping while under load, the support member 15 has the important task of realising adjustment of the angle between the carrier arms 1 and the support strut 6 so that the tread platform 2 may be held horizontal irrespective of the location and inclination of the subject matter of the present invention, on the stem 19 of the boat. Furthermore, the support member permits that the upper abutment portions 4 be urged upwardly against the boarder sections of the hull, whereby a positionally-fixing wedge effect will be created. Finally, the support member also has a purely adjusting function, since tightening of the nut 12 will often require a certain relaxing of the nut 17 in that the friction-increasing coatings on the abutment portions are compressed As was mentioned above, the subject matter of the present invention has been designed in such a manner that it may be used on a large number of different boat models. This entails, among other things, that the towing ring 9 may be placed at different positions on the boat, for which reason the tensioning device 10 according to the present invention is shiftable along the support strut 6. In the embodiment illustrated on the Drawings, this is realised in that the opening 11 is slot-shaped. A certain flexibility may also be realised in that there are disposed, either in the slot-shaped opening or in some other manner, alternative anchorage points for a so-called shroud screw which, thereby, is freely pivotal in relation to the support strut 6 and is fixed, with its end facing the boat, in the ring 9.

In the event that the subject matter of the present invention is to be placed on a boat with a generally vertical stem, the joint 14—which, in the illustrated embodiment consists of a pin extending through both the adjustment rails and the support strut 6—is split. This joint 14 is moved, in such a case, outwardly towards the outer ends of the carrier arms 1. Furthermore, in this case, angle adjustment must be effected between the carrier arms 1 and the support strut 6, by means of the support member 15, and the support member must be shifted in the longitudinal direction of the support strut 6, which, as has been intimated above, may simply be realised in that the support member 15 extends through the slot-shaped opening 16. Naturally, the support member 15 may also be provided with a number of alternative anchorage points in the support strut 6 if it is designed in a corresponding manner.

In one alternative to the above-described shifting of the joint 14, either the pair of carrier arms 1, and the support strut 6, or possibly both, may be of telescopic design so that there is thereby realised an adjustment of the abutment portions 4 and 7 in a direction towards and away from the boat.

As an alternative to the upper, pivotally retained abutment portions 4, use may also be made of rigidly anchored abutment portions which may suitably be manufactured of semi-hard rubber and which may be of more or less spherical configuration so that, irrespective of the orientation of the adjacent surfaces of the boat hull, they will come into abutment against these surfaces.

In the discussion relating to the accompanying Drawings as set out above, the invention has been described as comprising two carrier arms 1 which are interconnected by means of the tread platform 2 and the cross piece 3. Naturally, as an alternative to this construction, use may be made of a single carrier member which is designed as an approximately planar panel with non-slip upper surface coating and with an approximately U-shaped recess in its end facing the boat, so that this U-shaped recess may embrace the stem of the boat, whereby both of the abutment portions 4, in conformity with the above-described embodiment, will be placed on either side of the cutting line of the stem.

According to the invention, it is not necessary that the support strut 6 be placed beneath the carrier arms 1 and the tread platform 2. Thus, as one alternative, the support strut 6 or any suitable equivalent support may be connected to the inner edge of the tread platform and extend obliquely upwardly towards the stem 19. In this case, the subject matter of the present invention will be placed lower than is the case in the above-described embodiment for one and the same location of the towing ring 9. Otherwise, the same construction principles may be used; however with that difference that the support member 15 and tensioning device 10 will be directed obliquely upwardly and obliquely downwardly, respectively, as opposed to that which applies in the above-described embodiment.

The invention as described above and set out on the accompanying Drawings may be modified without departing from the spirit and scope of the appended claims.

I claim:

1. A boarding step for mounting on a boat comprising, a tread platform; a first abutment member adapted to be in contact with the boat below said platform; a strut member connecting said platform and said first abutment member; a carrier arm connected to said platform and fastening means adapted for fastening said boarding step to a boat, said strut member being connected to said platform by means of first adjustment means thereby permitting the strut member to pivot, said carrier arm having second abutment means adapted for contacting the boat, said carrier arm and said strut member being interconnected by means of a second adjustment means to enable the angular positioning of the strut member and the carrier arm, and said fastening means being connected to the strut member above said first abutment member and adapted to urge said first and second abutment members against a boat.

2. The boarding step of claim 1, wherein said first adjustment device has a series of openings arranged in the longitudinal direction of said carrier arm, said strut member being pivotably connected to any selected one of said openings by means of a pivotal anchorage means.

3. The boarding step or claim 1, wherein said first and second abutment members being adjustably fastened to said strut member and said carrier arm respectively, thereby allowing the abutment members to be adjustably positioned in dependence of the orientation of any adjacent surface of a boat.

4. The boarding step as defined in claim 1 attached to a boat.

5. A boarding step for mounting on a boat comprising, a tread platform; a first abutment member adapted to be in contact with the boat below said platform; a strut member connecting said platform and said first abutment member; carrier means connected to said platform and fastening means adapted for fastening said boarding step to a boat, said strut member being connected to said platform by means of first adjustment means thereby permitting the strut member to pivot, said carrier means comprising two carrier arms, each connected to said platform and each having a second abutment means adapted for contacting a boat, said carrier arms and said strut member being interconnected by means of a second adjustment means to enable the angular positioning of the strut member and the carrier arms, and said fastening means being connected to the strut member above said first abutment member and adapted to urge said first and second abutment members against the boat.

6. The boarding step of claim 5, wherein said first adjustment device has a series of openings arranged approximately in the longitudinal directions of said carrier arms, said strut member being pivotably connected to any selected one of these openings by means of a pivotal anchorage means.

7. The boarding step of claim 5, wherein said first and second abutment members are adjustably fastened to said strut member and said carrier arms respectively, thereby allowing the abutment members to be adjustably positioned in dependence of the orientation of any adjacent surface of a boat.

* * * * *